United States Patent [19]

Hovhannessian

[11] 4,057,855

[45] Nov. 15, 1977

[54] ADJUSTABLE SUN HAT

[76] Inventor: Karnig Hovhannessian, 5154 Romaine St., Los Angeles, Calif. 90029

[21] Appl. No.: 631,533

[22] Filed: Nov. 13, 1975

[51] Int. Cl.[2] ..... A42B 1/18

[52] U.S. Cl. ..... 2/177

[58] Field of Search ..... 2/177, 182.6, 175, 171, 2/180, 182.1, 8

[56] References Cited

U.S. PATENT DOCUMENTS

| | | | |
|---|---|---|---|
| 2,238,994 | 4/1941 | Dockson et al. | 2/8 |
| 2,252,902 | 8/1941 | Subira et al. | 2/182.6 |
| 3,305,201 | 2/1967 | Thiel | 2/177 X |
| 3,585,643 | 6/1971 | Ryan | 2/177 |

FOREIGN PATENT DOCUMENTS

| | | | |
|---|---|---|---|
| 468,911 | 2/1952 | Italy | 2/177 |
| 779,920 | 7/1957 | United Kingdom | 2/177 |

*Primary Examiner*—Werner H. Schroeder
*Assistant Examiner*—Peter Nerbun
*Attorney, Agent, or Firm*—Lyon & Lyon

[57] ABSTRACT

Disclosed herein is an adjustable hat for protecting one from the rays of the sun. The hat is comprised of a collapsible pleated body portion disposed about a central support and a headband assembly. The headband assembly includes an upper support band which is carried by and slidably mounted on the underside of the central support and an adjustable circular headband which is adapted to fit about the wearer's head and is pivotally connected to the upper support band so that the hat can be adjusted to any desired angular position on the wearer's head to block the sun's rays.

6 Claims, 9 Drawing Figures

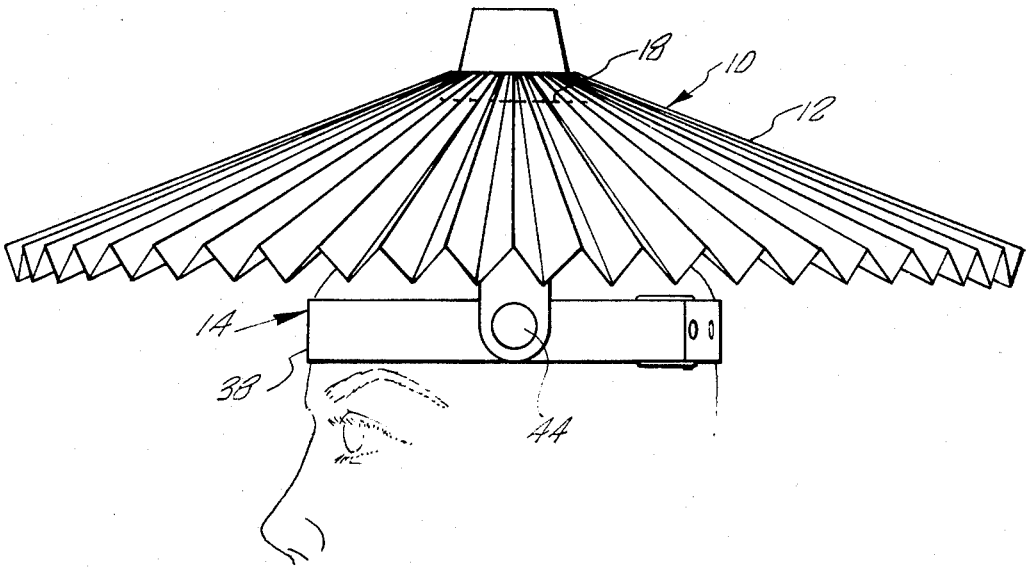
FIG. 1
FIG. 2
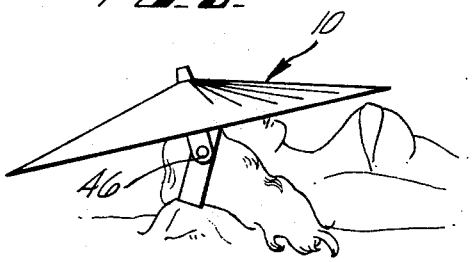
FIG. 3
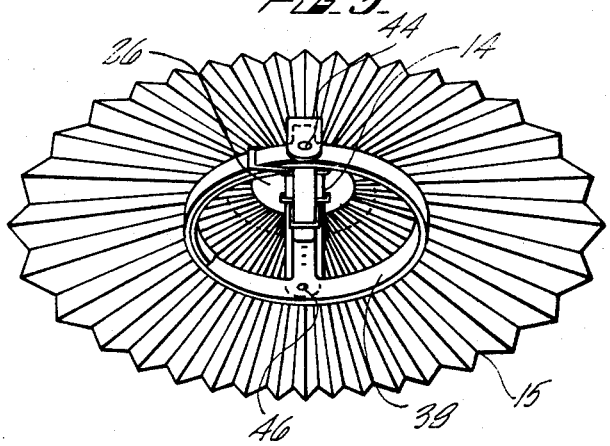
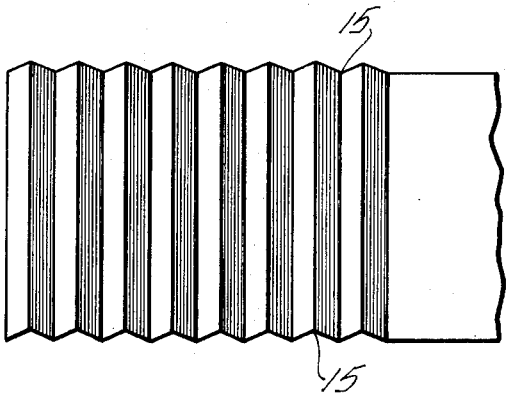
FIG. 4
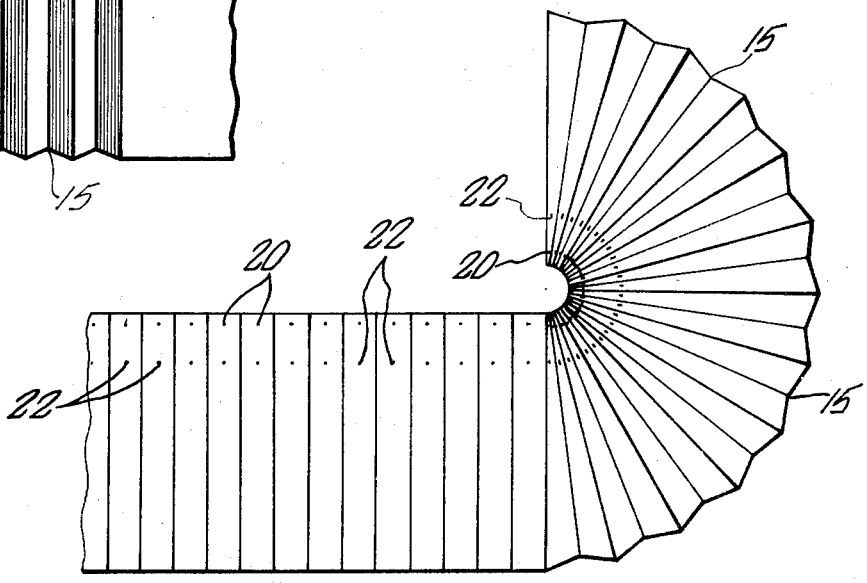
FIG. 5

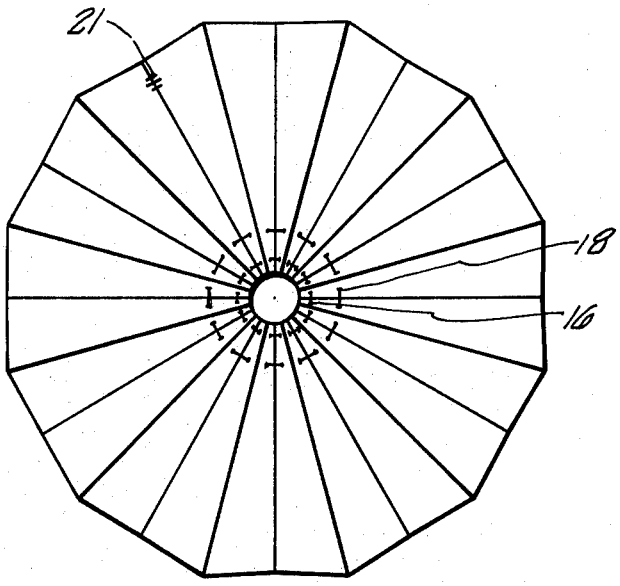
FIG. 6
FIG. 9
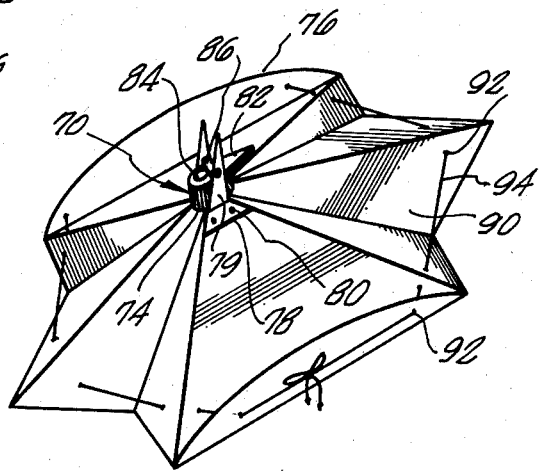
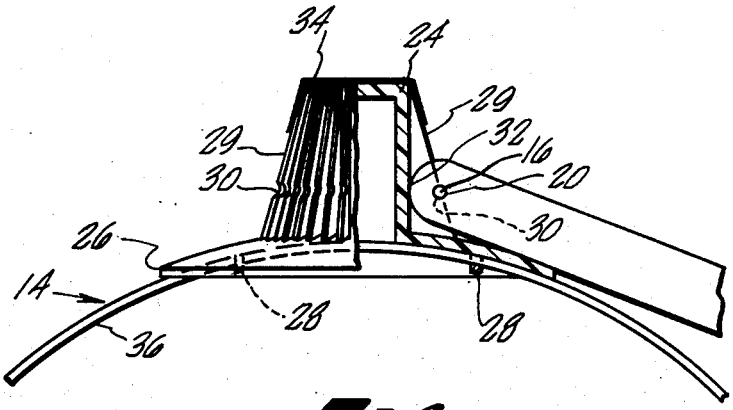
FIG. 8
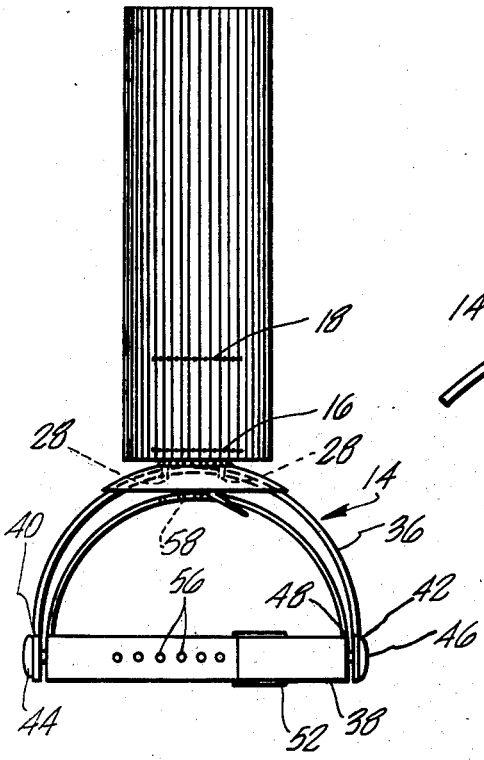
FIG. 7

ADJUSTABLE SUN HAT

BACKGROUND OF THE INVENTION

Various types of hats and assorted head gear have heretofore been used by countless numbers of individuals to protect themselves from the sun. Typically such devices are quite large and cumbersome and have limited flexibility. To adjust the hat to a change in the orientation of the person with respect to the sun's rays, the hat must be tilted on the wearer's head and this can only be done to a limited extent. Some devices such as that taught in U.S. Pat. No. 3,585,643, do include means for adjusting the orientation of the hat on the wearer's head, however, the means used therein is still somewhat limited due to the necessity of the hat being anchored to the wearer's hair and, as with conventional sun hats, it is quite cumbersome. Additionally, a sun hat should not only be highly flexible so that it can be readily adjusted to block the sun regardless of the relative positioning of the sun with respect to the wearer, but it should be attractive as well. Accordingly, the present invention provides a sun hat which is highly flexible with respect to its angular orientation on the wearer's head, readily collapsible for carrying and also quite attractive.

SUMMARY OF THE INVENTION

Briefly, the invention comprises a sun hat having a pleated collapsible shade providing body portion and a headband assembly which is adapted to fit about the wearer's head and carries the body portion such that the body portion can be pivoted to any desired angular orientation with respect to the wearer's head to shield the wearer from the sun regardless of the inclination of the sun to the wearer.

It is the principal object of the present invention to provide a readily adjustable sun hat which can be pivoted to any desired position on the wearer's head to shield the wearer from the sun's rays regardless of the inclination of the sun to the wearer.

It is another object of the present invention to provide a sun hat which is both readily adjustable on the wearer's head and easily collapsible to facilitate carrying.

It is still further object of the present invention to provide a decorative sun hat for shielding the wearer from the rays of the sun.

These and other objects and advantages of the present invention will become apparent from the following detailed description taken in conjunction with the accompanying drawings.

BRIEF DESCRIPTION OF THE DRAWINGS

FIG. 1 is a side elevation of the sun hat worn by the person in an upright position.

FIG. 2 is a side elevation of the sun hat worn by a person in a reclining position.

FIG. 3 is a perspective view of the underside of the sun hat illustrating the headband assembly.

FIGS. 4–6 are plan views of the body portion of the sun hat illustrating the construction thereof.

FIG. 7 is a side view of the sun hat in a collapsed disposition.

FIG. 8 is a partial view of the headband assembly.

FIG. 9 is a perspective view of a second embodiment of the sun hat.

DESCRIPTION OF A PREFERRED EMBODIMENT

Referring now in detail to the drawings, the sun hat 10 is comprised of a pleated body portion 12, a central support member 24, a headband assembly 14 which carries the body portion and is adapted to fit about the wearer's head as seen in FIGS. 1 and 2. The body portion of the hat is preferably constructed of a decorative rectangular sheet of paper sandwiched between two sheets of transparent plastic material to provide a durable and attractive hat, although solely paper or plastic material could be used. Zig-zag parallel pleats 15 are formed in the decorative sheet and the ends thereof are drawn and held together by means of elastic bands 16 and 18 which extend through sets of apertures 20 and 22 and a plurality of standard fasteners such as staples 21 as shown in FIGS. 4–6.

The central support member 24 which extends through the central opening in the frustoconically shaped body portion is preferably of single piece construction, made of a plastic material and has a concave base portion 26, a pair of brackets 28 depending therefrom and a plurality of upstanding fins 29. Each fin is tapered upwardly as shown in FIG. 8 and has a notch 30 cut in the sloped edge thereof. In constructing the sun hat 10, the inner edges 32 of the pleated body portion 12 are disposed between the upstanding fins 29 in the central support member 24 and the inner band 16 is extended and disposed through the inner apertures 20 in the body portion of the hat, the notches 30 in the fins 29 and joined at its ends whereby the body portion 12 of the hat is secured to the support member 24. A decorative cap 34 can be disposed above the upper ends of the fins to enhance the appearance of the hat if desired.

The headband assembly 14 also includes an upper support band 36 which extends through the brackets 28 of the support member and is slidably held thereby and an adjustable headband 38 which is pivotally secured to the upper support band 36 at 40 and 42 by means of pins 44 and 46 or other conventional attachment means. In the preferred embodiment of the invention, the headband assembly 14 also includes an upper semi-circular band 50 which can be secured to or integrally formed with the adjustable band 38 at 48 and fits over the top of the wearer's head to firmly hold the hat in place. Both the circular band 38 and upper semi-circular band 50 are preferably constructed of a soft lightweight plastic material and are provided with means for adjusting the band to the size of the wearer's head. Locking buckles 52 and 54 which cooperate with apertures 56 and 58 in the band are suitable for this purpose. Such structure provides a high degree of flexibility in the hat in that the body portion can be pivoted to either side of the wearer's head by virtue of the upper support band being slidably disposed between the underside of the concave base portion 26 of the headband assembly 14 and brackets 28, and pivoted forwardly and rearwardly on the wearer's head by virtue of the upper support band 36 being pivotally secured to headband 38. In addition the hat 10 can be easily collapsed (see FIG. 7) for carrying purposes by turning the body portion inside-out causing the inner edges of the pleated body portion to rotate between fins 29 until the body portion reaches the configuration illustrated in FIG. 7.

A second embodiment of the invention is illustrated in FIG. 9. The headband assembly 70 incorporated therein is quite similar to that in the prior embodiment with the exception of the central portion 72 which extends through an aperture 74 in the body portion 76 of the hat which does not include the tapered fins of the prior embodiment. Fastening means 78 are provided for securing the body portion 76 of the hat to the central cylindrical portion 72 of the headband assembly. The decorative means illustrated in the drawing include a pair of brackets 79 which are secured to the body portion of the hat by a pair of fasteners 80 and an elongated tab 82 which is secured to the headband assembly by means of a threaded fastening member 84 or other suitable fastening means. The elongated tab extends over a transversely disposed pin 86 which is held by brackets 78 thereby securing the body portion of the hat to the headband assembly. The body portion 76 of the second embodiment of the hat as with the prior embodiment, can be constructed of a decorative paper sandwiched between two sheets of transparent plastic or solely of paper or plastic material. The body portion 76 defines enlarged side portions 88 and longitudinal pleats 90 which allow the body portion of the hat to be collapsed about the headband assembly. Finally apertures 92 can be disposed about the perimeter portion of the body portion of the hat to receive a cord 94. By varying the tension of the cord the pleats are drawn together thereby tending to collapse the hat and effectively changing the size thereof.

Various changes and modifications may be made in carrying out the present invention without departing from the spirit and scope thereof. Insofar as these changes and modifications are within the purview of the appended claims they are to be considered as part of the invention.

I claim:

1. An adjustable sun hat comprising a headband assembly, a central support member carried by said headband assembly and slidably mounted thereon about a first axis, a body portion defining a plurality of radially extended pleats (carried by) is pivotally secured to said central support member such that said body portion can be pivoted upwardly with respect to said central support member to substantially collapse said body portion to facilitate carrying, and means for pivoting said central support member and said body portion with respect to said headband assembly about a second axis, said second axis being substantially perpendicular to said first axis whereby said body portion of said hat can be positioned in any desired angular orientation on the wearer's head to block the sun's rays.

2. An adjustable sun hat comprising a central support member, a body portion defining a plurality of radially extending pleats therein, said body portion being carried by and pivotally secured to said central support member, an arcuate support member, said central support member being carried by and slidably mounted on said arcuate support member for movement about a first axis and a headband assembly, said assembly being pivotally secured to said arcuate support member for rotational movement about a second axis, said second axis being substantially perpendicular to said first axis whereby said body portion of said hat can be positioned in any desired angular orientation on a wearer's head to block the sun's rays.

3. The combination of claim 2 wherein said central support member includes a plurality of radially extending fins, said fins being disposed between adjacent pleats of said body portion of said hat and each of said fins having a groove adjacent the outer edge thereof and said body portion having a plurality of apertures therein adjacent the inner edge thereof and in alignment with said grooves, and an elastic band extending through said apertures and said grooves thereby allowing the body portion of said hat to pivot upwardly with respect to said central support member while tending to maintain the configuration of the body portion of said hat.

4. The combination of claim 3 including a second plurality of apertures in said body portion of said hat, said second plurality being spaced radially outwardly from said first plurality and an elastic band extending through said apertures to maintain said body portion of said hat in a frustoconical configuration.

5. An adjustable sun hat comprising a headband assembly, a central support member carried by said headband assembly and slidably mounted thereon about a first axis, a collapsible body portion pivotally secured to said central support member and means for pivoting said central support member and said body portion with respect to said headband assembly about a second axis, said second axis being substantially perpendicular to said first axis whereby said body portion of said hat can be positioned in any desired angular orientation on the wearer's head to block the sun's rays.

6. An adjustable sun hat comprising a headband assembly, a central support member having a plurality of radially extending fins and being slidably mounted on said headband assembly about a first axis, a body portion carried by said central support member and defining a plurality of radially extending pleats therein, and means for pivoting said central support member and said body portion with respect to said headband assembly about a second axis, said radially extending fins of said support member being disposed between adjacent pleats of said body portion of said hat and each of said fins having a groove adjacent the outer edge thereof and said body portion having a plurality of apertures therein adjacent the inner edge thereof and in alignment with said grooves, and an elastic band extending through said apertures and said grooves allowing the body portion of said hat to pivot upwardly with respect to said central support member while tending to maintain the configuration of the body portion of said hat.

* * * * *